US006685039B2

(12) United States Patent
Bauer et al.

(10) Patent No.: US 6,685,039 B2
(45) Date of Patent: Feb. 3, 2004

(54) OUTRIGGER ASSEMBLY FOR SUPPORT OF MOBILE CRANES, EXCAVATORS AND THE LIKE ON THE GROUND

(75) Inventors: Martin Bauer, Steinwenden (DE); Klaus Conrad, Hornbach (DE); Jens Fery, Ensdorf (DE); Rolf Heintz, Langwleden (DE); Mario Rübel, Waldmohr (DE); Sascha Scholz, Zweibrücken (DE)

(73) Assignee: Terex-Demag GmbH & Co. KG, Zweibrücken (DE)

( * ) Notice: Subject to any disclaimer, the term of this patent is extended or adjusted under 35 U.S.C. 154(b) by 0 days.

(21) Appl. No.: 09/993,330

(22) Filed: Nov. 14, 2001

(65) Prior Publication Data

US 2002/0070188 A1 Jun. 13, 2002

(30) Foreign Application Priority Data

Nov. 14, 2000 (DE) ..... 100 56 799

(51) Int. Cl.[7] ..... B66C 23/78
(52) U.S. Cl. ..... 212/302; 212/303
(58) Field of Search ..... 212/301, 302, 212/303, 304, 305, 347, 348, 349, 350; 280/763.1, 764.1, 765.1, 766.1

(56) References Cited

U.S. PATENT DOCUMENTS

| | | | | | |
|---|---|---|---|---|---|
| 3,265,145 | A | * | 8/1966 | Beitzel | 180/8 |
| 3,599,380 | A | * | 8/1971 | Menzi | 52/155 |
| 3,784,035 | A | * | 1/1974 | Dunbar | 214/75 H |
| 4,018,458 | A | * | 4/1977 | Shumaker | 280/766 |

FOREIGN PATENT DOCUMENTS

| | | | | |
|---|---|---|---|---|
| DE | 2317595 | * | 10/1974 | 212/350 |
| DE | 297 19 953 U1 | | 2/1999 | |

* cited by examiner

*Primary Examiner*—Thomas J. Brahan
(74) *Attorney, Agent, or Firm*—Henry M. Feiereisen

(57) ABSTRACT

An outrigger assembly for support of a mobile crane or excavator upon the ground, includes a plurality of outriggers mounted to a vehicle frame and having free ends, wherein each of the outriggers has a ground-engaging pad connected to the free ends for vertical movement in relation to the ground. Each of the outriggers has at least one outrigger arm unit movable with respect to the vehicle frame between an idle position suitable for travel between sites, and an operative position suitable for support on the ground, wherein the outrigger arm unit includes an outrigger arm made of a hollow profile which has a lower part of U-shaped configuration and an upper part of calotte-shaped configuration.

9 Claims, 3 Drawing Sheets

OUTRIGGER ASSEMBLY FOR SUPPORT OF MOBILE CRANES, EXCAVATORS AND THE LIKE ON THE GROUND

CROSS-REFERENCES TO RELATED APPLICATIONS

This application claims the priority of German Patent Application Serial No. 100 56 799.1, filed Nov. 14, 2000, the subject matter of which is incorporated herein by reference.

BACKGROUND OF THE INVENTION

The present invention relates, in general, to a ground support for mobile cranes, excavators and the like.

German Pat. No. DE 297 19 953 U1 describes an outrigger assembly for support of a mobile crane on the ground. The mobile crane has a frame structure oriented in the longitudinal axis of the vehicle and includes for crane operation a four-point outrigger assembly which is partially associated to the forward end of the frame structure and partially to the rearward end. Each outrigger has an outer outrigger arm and an inner outrigger arm movably disposed in the outer outrigger arm. Each outer outrigger arm is movably received in an opening of the frame structure in a direction transversely to the longitudinal axis, with two outrigger arms being supported behind one another in longitudinal axis, with two outrigger arms being supported behind one another in parallel relationship in the direction of the longitudinal frame axis. Mounted to each end of the inner outrigger arm is a support cylinder which is movable in vertical direction with respect to the ground and has free ends for attachment of a support pad. The inner and outer outrigger arms have a rectangular cross section, which is disadvantageous in connection with a buckling resistance of the outrigger assembly so that a great wall thickness must be selected in the region of the upper side, thereby adversely affecting the ineffectual own weight of the crane.

FIG. 2 shows a perspective illustration of an outrigger assembly at the aft of a ground support, with the outrigger assembly having outrigger arms 5.1, 5.2 of hollow box-shaped configuration with conventional rectangular cross section 9, as clearly shown at the visible end face of the outrigger arm 5.2 on the right-hand side of FIG. 2. The outrigger arms 5.1 may be secured to a vehicle frame 1 via a support box 30, or may also be mounted directly to the vehicle frame. When exposed to a load, the load applies a force in a direction as indicated by arrow 10 upon the frame structure 1 and consequently also upon the outrigger assembly. As the outrigger assembly buckles elastically downwards in response to the force 10, the top side 11 of, e.g., the inner outrigger arm 5.2 is exposed to pressure, whereas the bottom side 12 thereof is under tension. As a consequence of the rectangular cross section 9 of the outrigger arms 5.1, 5.2, the buckling resistance is low so that the wall thickness of the top side 11 must be accordingly reinforced. Thus, the weight of the outrigger arms 5.1, 5.2 and therefore the ineffectual own weight of the frame structure 1 becomes greater.

It would therefore be desirable and advantageous to provide an improved outrigger assembly for mobile cranes, excavators and the like, to obviate prior art shortcomings and to exhibit a better weight configuration.

SUMMARY OF THE INVENTION

According to one aspect of the present invention, an outrigger assembly for support of a mobile crane or excavator upon the ground, includes a plurality of outriggers mounted to a vehicle frame and having free ends, wherein each of the outriggers has a ground-engaging pad connected to the free ends for vertical movement in relation to the ground, wherein each of the outriggers has at least one outrigger arm unit movable with respect to the vehicle frame between an idle position suitable for travel between sites, and an operative position suitable for support on the ground, wherein the outrigger arm unit includes an outrigger arm made of a hollow profile which has a lower part of U-shaped configuration and an upper part of calotte or cap-shaped configuration.

The present invention resolves prior art problems by providing the outrigger arm by way of a two part configuration so that vehicle frame as well as the outrigger arms are elastically pushed downwards by a suspended load. As a consequence, the upper side of the outrigger arms is subjected to pressure and the bottom side of the outrigger arms is subjected to a tensile load. By providing a rounding of the upper part of the profile of the outrigger arms, the buckling resistance is enhanced so that the wall thickness can be accordingly reduced. As a result, the outrigger arm can be made lighter overall so that the ineffectual own weight is reduced.

The upper part of the profile may be half-round, half-oval or of elliptic configuration. In the event of an elliptic configuration, the smaller radius may lie in the apex. With respect to the arrangement of the support pans in the end zone of the outrigger arms, the cross section of the profile may be so provided as to have two curved sections as mirror images of one another, whereby a straight horizontal section is provided in the apex area. The horizontal section can be sized small enough to allow attachment of the support cylinder while not affecting the buckling resistance. Suitably, both curved sections are configured as arcuate segments having centers which are offset relative to the vertical axis of symmetry.

The outrigger arms may be made in one piece as profiled member or may be made of two shells which have been welded together at the confronting legs of the upper and lower parts.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
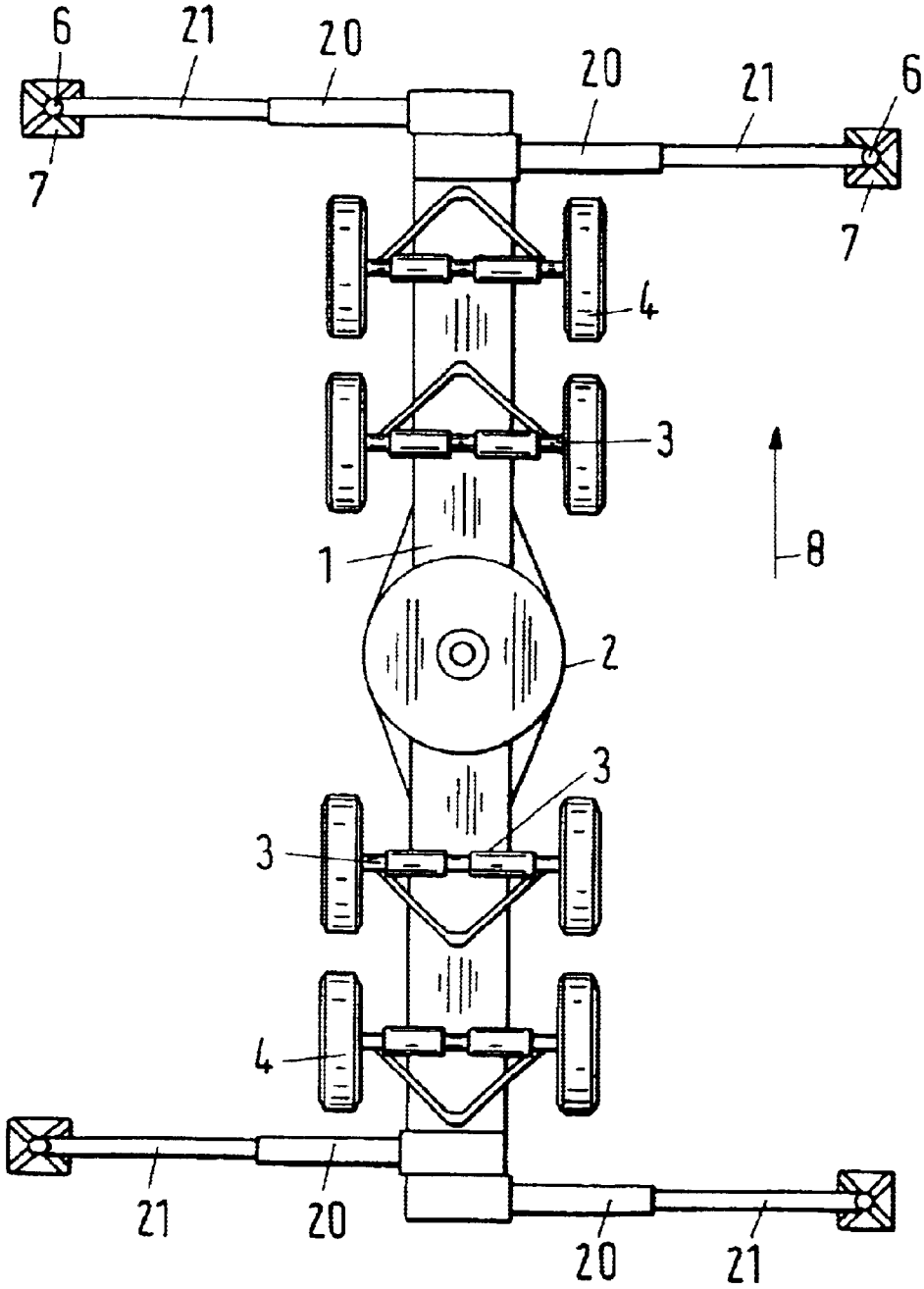
FIG. 1 is a plan view of a four-point ground support for a mobile crane incorporating an outrigger assembly in accordance with the present invention.

Throughout all the Figures, same or corresponding elements are generally indicated by same reference numerals.

Turning now to the drawing, and in particular to FIG. 1, there is shown a plan view of a four-point ground support for a mobile crane incorporating an outrigger assembly in accordance with the present invention. The ground support, also called carrier, includes a frame structure 1 which extends in longitudinal direction of the mobile crane and is provided with a central turret or turning circle 2 for rotatable support of the superstructure, not shown. In the nonlimiting example of FIG. 1, the frame structure 1 has four axles 3, each of which supports a wheel 4 on the left side and a wheel 4 on the right side. In the direction of travel of the mobile crane as indicated by arrow 8, the frame structure 1 has a front portion provided with an outrigger assembly and a rear portion provided with an outrigger assembly, with the two outrigger assemblies thus being arranged behind one another in parallel disposition. As the fore-and-aft outrigger assemblies are of identical construction, it will be understood by persons skilled in the art that a description of one of the outrigger assemblies is equally applicable to the other outrigger assembly.

Each outrigger assembly includes two outrigger arms units comprised of an outer outrigger arm 20 and an inner outrigger arm 21, which are telescopically movable relative to one another. Arranged at the outer free end of the inner outrigger arm 21 is a support cylinder 6 of an actuating mechanism, not shown. A ground-engaging pad 7 is mounted to the outer end of the cylinder 6.

Figure 3:
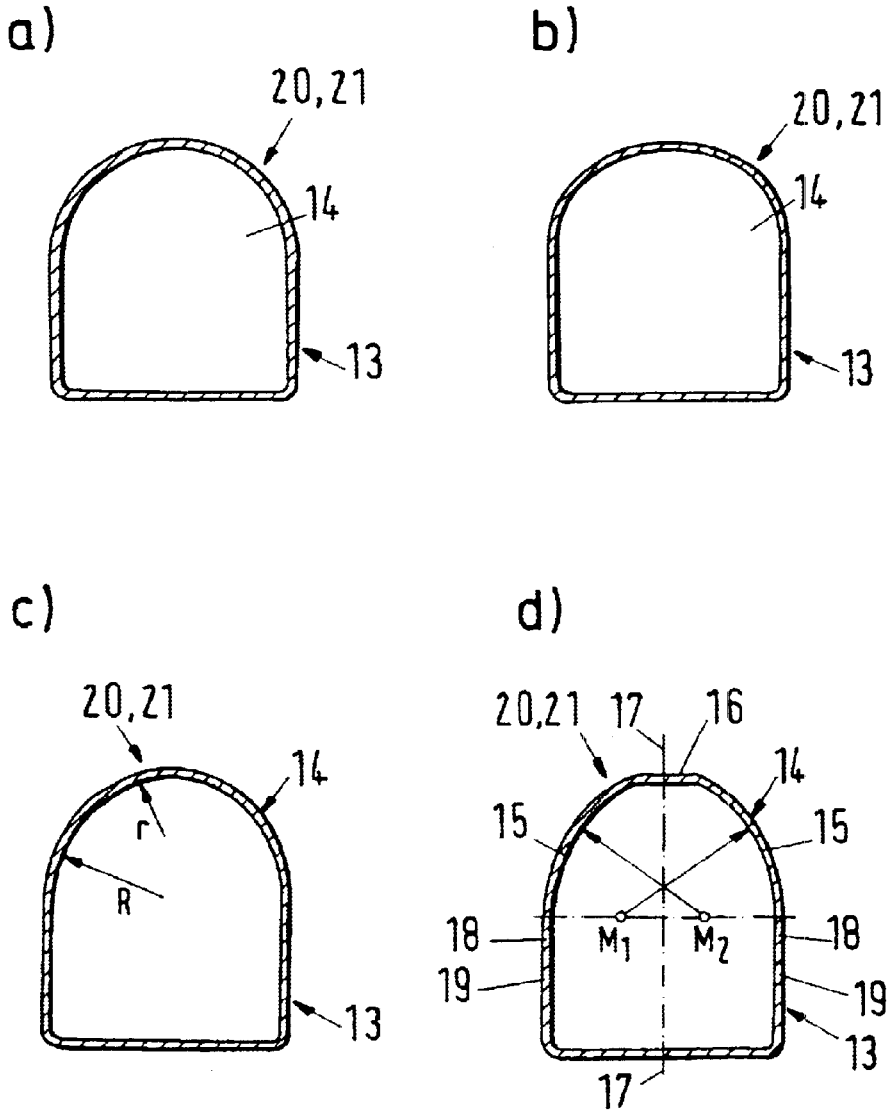
FIGS. 3*a*–3*d* show cross sectional configurations of an outrigger arm in accordance with the present invention.

Turning now to FIGS. 3*a*–3*d*, there are shown cross sectional configurations of the outrigger arms 20, 21 in accordance with the present invention. Each of the outrigger arms 20, 21 has a bottom part 13 of U-shaped configuration and an upper part 14 of generally calotte or cap-shaped configuration. In FIG. 3*a*, the upper part 14 has a half-round cross section, while in FIG. 3*b* the upper part 14 has an oval shape, and in FIG. 3*c* the upper part 14 has an elliptic shape defined by a great radius R and a small radius r, whereby the small radius r of the ellipse in located in the area of the apex.

Figure 2:
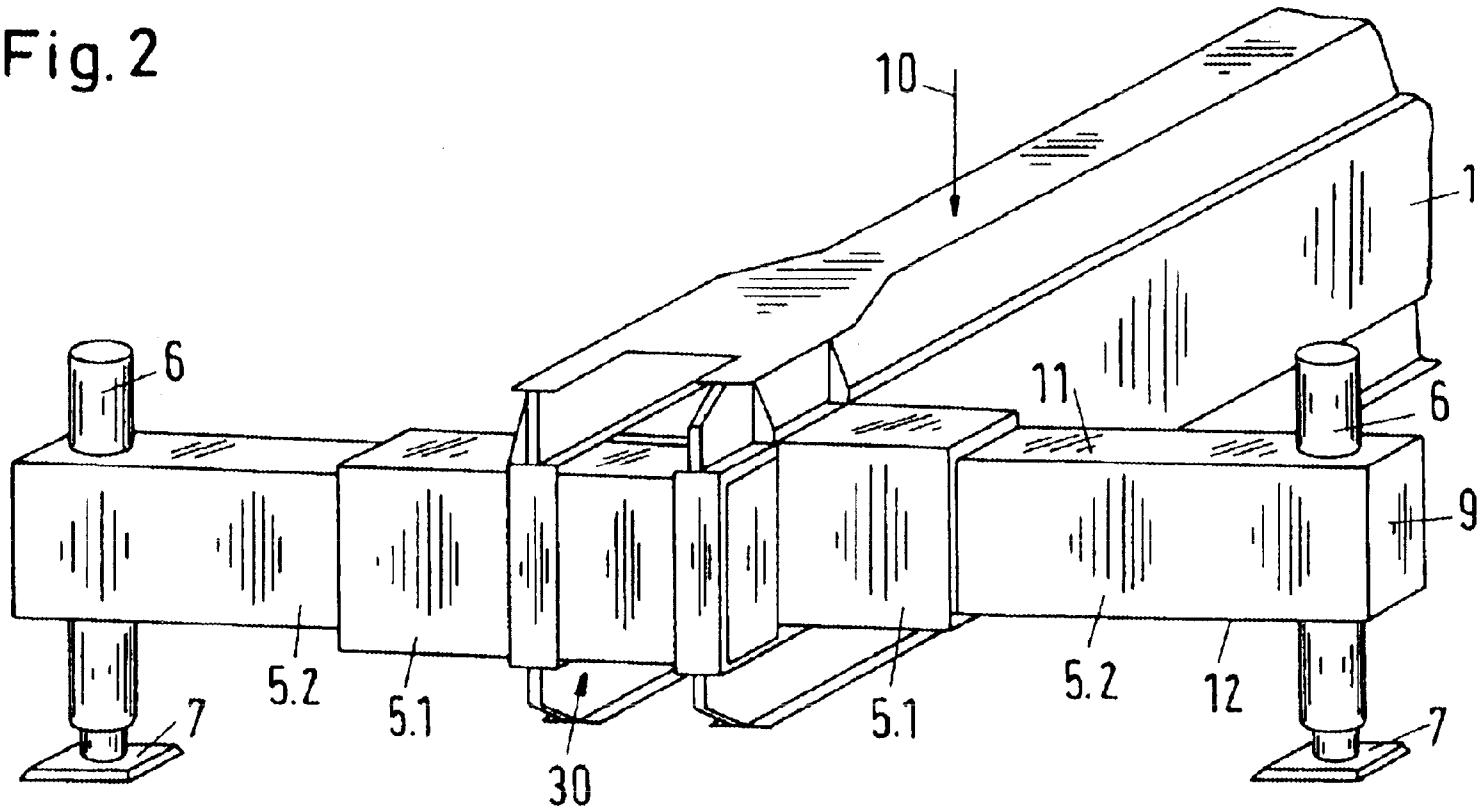
FIG. 2 is a perspective illustration of an outrigger assembly at a rearward part of a ground support, having outrigger arms of conventional cross section.

FIG. 3*d* shows a currently preferred variation in which the upper part 14 is comprised of two curved sections 15 positioned as mirror images of one another and interconnected in the area of the apex by a substantially straight horizontal section 16 which should be of smallest possible length that allows installation of the support cylinder 6 (FIG. 2) on the one side while still not adversely affecting the resistance to buckling on the other side. Suitably, the curved sections 15 are configured as arcuate segments defined by centers $M_1$, $M_2$ which are disposed offset to the vertical symmetry axis 17

Each of the outrigger arms 20, 21 may be made in one piece as a hollow profile, or, as shown in FIG. 3*d*, may be comprised of two shells, whereby confronting legs 18, 19 of the lower and upper shells 13, 14 are preferably welded together.

While the invention has been illustrated and described as embodied in an outrigger assembly for support of mobile cranes, excavators and the like on the ground, it is not intended to be limited to the details shown since various modifications and structural changes may be made without departing in any way from the spirit of the present invention.

What is claimed as new and desired to be protected by Letters Patent is set forth in the appended claims:

1. An outrigger assembly for support of a mobile crane or excavator upon the ground, comprising a plurality of outriggers mounted to a vehicle frame and having free ends, wherein each of the outriggers has a ground-engaging pad connected to the free ends for vertical movement in relation to the ground, wherein each of the outriggers has at least one outrigger arm unit movable with respect to the vehicle frame between an idle position suitable for travel between sites, and an operative position suitable for support on the ground, wherein the outrigger arm unit includes an outrigger arm made of a hollow profile consisting of a lower part and an upper part of different configuration, wherein the lower part is of U-shaped configuration and the upper part is of inverted U-shaped configuration with a cross section that is different than a cross section of the U-shaped lower part.

2. The outrigger assembly of claim 1, wherein the outrigger arm is secured directly to the vehicle frame.

3. The outrigger assembly of claim 1, wherein the outrigger arm moves in and out via a support box mounted to the vehicle frame.

4. The outrigger assembly of claim 1, wherein the upper part is half-round.

5. The outrigger assembly of claim 1, wherein the upper part is half-oval.

6. The outrigger assembly of claim 1, wherein the upper part has an elliptic configuration defined by a small radius and a great radius and having an apex which is defined by the smaller radius.

7. The outrigger assembly of claim 1, wherein the upper part has two curved sections arranged as mirror images of one another and an apex in the form of a straight section which terminates on both sides tangentially in the curved sections respectively.

8. The outrigger assembly of claim 7, wherein the hollow profile defines an axis of symmetry, wherein the curved sections are configured as arcuate segments, each of which defined by a center wherein the center of one arcuate segment and the center of the other arcuate segment are located in offset relationship to the axis of symmetry.

9. The outrigger assembly of claim 1, wherein the upper and lower parts of the hollow profile are each configured as shell, with confronting legs of the shells of the upper and lower parts being welded together.

* * * * *